US008367961B2

(12) United States Patent
Rainer

(10) Patent No.: US 8,367,961 B2
(45) Date of Patent: Feb. 5, 2013

(54) GROUND PEG, AND DEVICE AND METHOD FOR THE PRODUCTION THEREOF

(75) Inventor: Stephan Rainer, Plattling (DE)

(73) Assignee: CORTEC GmbH, Plattling (DE)

( * ) Notice: Subject to any disclaimer, the term of this patent is extended or adjusted under 35 U.S.C. 154(b) by 0 days.

(21) Appl. No.: 12/736,479

(22) PCT Filed: Apr. 9, 2009

(86) PCT No.: PCT/EP2009/002646

§ 371 (c)(1),
(2), (4) Date: Feb. 15, 2011

(87) PCT Pub. No.: WO2009/124769

PCT Pub. Date: Oct. 15, 2009

(65) Prior Publication Data

US 2011/0127313 A1 Jun. 2, 2011

(30) Foreign Application Priority Data

Apr. 9, 2008 (DE) ..... 20 2008 004 967 U
Apr. 21, 2008 (DE) ..... 10 2008 019 970

(51) Int. Cl.
*B23K 9/032* (2006.01)
*F16M 13/00* (2006.01)

(52) U.S. Cl. ..... 219/62; 219/61; 219/125.11; 219/607; 228/165; 228/235.2; 248/530

(58) Field of Classification Search ..... 228/102, 228/165, 235.2; 219/62, 607, 617, 61, 125.11; 248/530

See application file for complete search history.

(56) References Cited

U.S. PATENT DOCUMENTS 3,140,378 A * 7/1964 Benninghoff ..... 219/610
3,246,116 A * 4/1966 Anderson et al. ..... 219/61

(Continued)

FOREIGN PATENT DOCUMENTS

DE 74 31 554 1/1976
DE 299 14 485 1/2000

(Continued)

OTHER PUBLICATIONS

"Dubbel Taschenbuch fuer den Maschinenbau", 16, Aufl. 1987, Hrsg. V. Beitz, W. u. Kuettner, K.-H. Springer-Verlag Berlin, Heidelberg, New York, Tokio. ISBN 3-540-18009-5, D. III, IV, G10-G12 Bilder (Figures) 9a,c,14d,15b.

*Primary Examiner* — Devang R Patel
(74) *Attorney, Agent, or Firm* — Davidson, Davidson & Kappel, LLC

(57) ABSTRACT

The invention relates to a ground peg (10) which is made from a steel tube (11) and comprises an upper cylindrical section (12), a lower section (16) that tapers towards the bottom to form a tip (14), and an external thread (26) that extends along at least part of the lower section (16) and is formed from a continuous sheet metal strip (28) welded onto an external surface (32) of the ground peg (10) by means of a continuous or regularly interrupted fillet weld (34). The external thread (26) has a nearly constant pitch (S) and slope (a) relative to a longitudinal axis (40) of the ground peg (10) along the entire length of the external thread (26). The invention further relates to a method or producing such a ground peg (10). In said method, the external thread (26) is laterally fed to the external surface (32) of the rotating steel tube as an elongate sheet metal strip (28) and is welded onto said external surface (32), the steel tube (11) being moved relative to the feeding point of the sheet metal strip (28) at a regular advance (V) in the longitudinal direction of the steel tube (11). The invention finally relates to a device for producing such a ground peg (10). Said device comprises a mechanism for clamping and rotating the steel tube as well as a mechanism (44) for feeding the sheet metal strip (28) to the external surface (32) of the steel tube (11) such that the sheet metal strip (28) tangentially rests there against.

13 Claims, 7 Drawing Sheets

U.S. PATENT DOCUMENTS

| | | | | |
|---|---|---|---|---|
| 5,482,246 | A * | 1/1996 | Derkoski | 248/530 |
| 5,609,456 | A * | 3/1997 | Joki | 411/433 |
| 6,166,348 | A * | 12/2000 | Brundermann | 219/61 |
| 6,412,235 | B1 * | 7/2002 | Pylant | 52/155 |
| 7,007,910 | B1 * | 3/2006 | Krinner et al. | 248/530 |

FOREIGN PATENT DOCUMENTS

| | | |
|---|---|---|
| DE | 198 36 370 | 2/2000 |
| DE | 299 23 796 U1 | 5/2001 |
| DE | 10 2005 045 574 | 4/2007 |

* cited by examiner

GROUND PEG, AND DEVICE AND METHOD FOR THE PRODUCTION THEREOF

The present invention relates to a ground peg as well as to a method for the production of such a ground peg. The invention also relates to a device for the production of such a ground peg.

BACKGROUND

Ground pegs serve to anchor objects such as columns or support frames in the ground. Thus, for example, solar collectors outdoors are often anchored in the ground with such ground pegs.

Such ground pegs exist in numerous different versions and dimensions. They normally consist of a tube section that has a constant diameter over a certain length. The lower section of the ground peg is conically tapered so that the ground peg can be screwed into the ground and can thus be firmly secured by displacing the soil. In order for the ground peg to be screwed in, it is provided with an external thread that can be formed, for example, by a welded-on sheet metal strip.

The conical section is normally welded onto the cylindrical section. The conical section is usually made out of a cylindrical tube section by means of a cold-forming method, so-called kneading or hammering. The lower tip can be formed, for example, by a welding and/or forging process. The external thread normally extends from the lower part of the cylindrical tube section past the conical section, reaching almost all the way to the lower tip.

Support columns or the like can then be slid into the tube section and affixed, usually by means of clamping screws, at the top, open end of the ground peg that extends slightly out of the ground.

A ground peg with a hammered conical section and a method for its production are disclosed in German patent application DE 198 36 370 A1. The body of this ground peg has a conical basic shape and a conical partial section. The body is produced by hammering a previously cylindrical tube. A similar ground peg with a hammered anchoring section is known from German utility model DE 299 23 796 U1.

The external threads of the prior-art ground pegs are wound and brought into the desired shape, they are subsequently slid over the circumferential surface in the lengthwise direction starting from the tip, and welded onto the surface. In the case of minor dimensional deviations, this can easily result in jamming or locking of the thread. Moreover, the pitch of at least the lower tapered section usually differs somewhat from the pitch of the other sections. The welding of the external thread is normally done by hand, and so are most of the other production steps, for example, the welding of the two tube sections of the ground peg, so that the production of the entire ground peg turns out to be very labor-intensive and thus relatively expensive.

Another problem can occur due to the multi-component structure and thus the resultant weakening in the vicinity of the weld seam. There are normally no problems when such ground pegs are screwed into loose soil. The rigid anchoring is achieved through the displacement of the soil by the ground peg as it is being screwed into the ground by means of its thread. In this manner, the ground peg can offer a play-free and very sturdy anchoring possibility, even with relatively loose soil. In the case of very rocky and hard subsoil, however, these ground pegs often reach the limits of their strength, and they tend to fail due to breakage, especially in the area where the cylindrical tube section is joined to the kneaded conical section. At a typical tube diameter of approximately 50 mm to 100 mm, a steel tube can have a wall thickness between approximately 1.5 mm and 2.5 mm. Since the same starting material is also used for the kneaded conical lower section, the wall thickness increases markedly downwards toward the tip, whereas in the upper area, near the weld seam, it is likewise only between 1.5 mm and 2.5 mm. Consequently, the conical section does not yield under high loads, but rather, it is especially torsionally stiff. However, on the other hand, since the conical section is subjected to the greatest torsional loads while the ground peg is being screwed into very hard subsoil, this load is almost completely transmitted to the upper area and to the weld seam, so that the latter tends to crack under very high loads.

SUMMARY OF THE INVENTION

It is an object of the present invention to create a ground peg that can be produced very efficiently and inexpensively, and to put forward a method to produce said ground peg. In this context, as many manufacturing steps as possible should be automated or partially automated, that is to say, these manufacturing steps should be performed with as little manual labor as possible. Another objective of the invention is to put forward an especially high-strength ground peg that is particularly well-suited for use in hard subsoil. Finally, a third objective of the invention is to put forward a simply structured device for the production of such a ground peg so as that it can be manufactured quickly and inexpensively.

The present invention provides ground pegs which are made from a steel tube, and which comprise an upper cylindrical section, a lower section that tapers downwards to form a tip, and an external thread that extends along at least a part of the lower section and that is formed from a continuous sheet metal strip that is welded onto an external surface of the ground peg by means of a continuous or regularly interrupted fillet weld. Along its entire length, the external thread has an approximately constant pitch and slope relative to the longitudinal extension of the ground peg. The external thread is formed by a sheet metal strip which runs with its narrow side helically around the cylindrical tube section and/or around the tapered lower section, and which is welded at least punctually and/or in sections onto the external surface of the ground peg. In this context, the external thread extends continuously and with a largely constant pitch between a lower area of the cylindrical section almost all the way to the lower tip of the tapered section. The external thread can especially be formed from an elongated sheet metal strip and/or from a sheet metal strip with a rectangular cross-section that is unwound from a roll. The external thread can be welded onto the external surface of the ground peg by means of a one-sided fillet weld or by means of a double-sided fillet weld.

In comparison to the ground pegs known so far, such a ground peg has the special advantage that the thread can be produced with great precision and very true-to-size, that is to say, with an approximately constant pitch, also in the tapered or conical section. The thread is unwound directly from a roll and welded directly onto the steel tube, preferably with a continuous and likewise very uniform weld seam that can be configured either as a simple one-sided fillet weld or as a double-sided fillet weld, as desired.

Another embodiment of the ground peg can provide that the upper section and the lower section are made in one piece from a single contiguous steel tube section. In this context, the lower section can have at least three longitudinal slits, whereby triangular sections are removed in the area of the longitudinal slits, so that the at least three strip sections thus created each taper to form a tip. Optionally, the lower section can have four, five or six longitudinal slits. Accordingly, the lower section can be formed by four, five or six strip sections.

The lower section can be formed, for example, by three, four or more strip sections, which each taper downwards toward the lower tip. Optionally, the strip sections can be welded to each other at least punctually and/or in sections at their side edges that are adjacent to each other. Optionally, the strip sections can also be welded to each other linearly along their side edges that are adjacent to each other. Moreover, the strip sections can be welded to each other at their tips, while forming a lower tip of the ground peg.

Preferably, the ground peg has a largely constant wall thickness in the cylindrical upper section and in the tapered lower section. Moreover, it can be provided that the lower section has a conical shape.

The ground peg according to the invention is especially sturdy and resistant, and it can also be used for very difficult types of ground without failing due to breakage. Since there is no weld seam between the upper section and the lower section, the risk of failure due to breakage or cracking in this area is eliminated. Since the ground peg is configured with a largely constant wall thickness in the lower tapered section, the ground peg remains torsion-elastic in all of the sections, and its ability to withstand high torsional loads while it is being screwed into difficult and very solid and/or especially hard types of ground far surpasses that of the conventional ground pegs which cannot yield to torsional loads because of their stiffness, as a result of which they abruptly fail, especially crack, when subjected to excessive loads.

The shape of the strip sections of this embodiment of the ground peg is maintained by means of the sheet metal strip of the external thread that is welded onto the outside of said strip sections, provided that they were not previously welded together along their side edges that are adjacent to each other. Since the application and welding of the external thread can also cause compression of the strip sections in the tapering shape of the ground peg, it is not absolutely necessary for the sheet metal strips to first be welded together.

The present invention also relates to a method for the production of a ground peg from a steel tube, comprising at least one upper cylindrical section, a lower section that tapers downwards to form a tip, and an external thread that extends along at least a part of the lower section and that is formed from a continuous sheet metal strip that is welded onto an external surface of the ground peg by means of a continuous or regularly interrupted fillet weld. In this process, the external thread is fed laterally to the external surface of the rotating steel tube as an elongated sheet metal strip and is welded onto said external surface, whereby the steel tube is moved relative to the feeding point of the sheet metal strip at a uniform advancing speed in the longitudinal direction of the steel tube.

Since the Sheet metal strip of the external thread is fed and welded over its entire length at an approximately constant pitch and slope relative to the longitudinal extension of the ground peg, a ground peg with precisely defined dimensions and properties can be created. The method allows very efficient partially automated or fully automated production since the entire welding procedure for applying the external thread can preferably be carried out with automatic rotation of the steel tube of the ground peg and with an automatic advance, which ensures the desired precision during the production of the weld seam.

The sheet metal strip of the external thread is fed at an approximately constant obtuse angle relative to the longitudinal extension of the steel tube, whereby this feeding angle is the pitch angle of the external thread. The sheet metal strip of the external thread is fed and welded with its longitudinal sides approximately perpendicular to the longitudinal axis of the steel tube. Moreover, it is provided that the steel tube of the ground peg rotates at a largely constant rotational speed compared to the advancing speed of the steel tube relative to the feeding point of the sheet metal strip during the welding of the sheet metal strip in the area of the upper cylindrical section. Moreover, it is provided that the steel tube of the ground peg rotates at an accelerated rotational speed compared to the advancing speed of the steel tube relative to the feeding point of the sheet metal strip during the welding of the sheet metal strip in the area of the tapered and conical lower section. Here, the rotational speed of the steel tube is uniformly increased as the distance of the sheet metal strip from the middle axis of the steel tube diminishes. Therefore, the smaller the distance of the sheet metal strip from the middle axis of the steel tube, the faster the steel tube rotates. These processes can be controlled by means of an appropriately programmed automatic device so that, at every point in time, the proper relationship exists between the advancing speed of the steel tube or of the fed sheet metal strip relative to the longitudinal axis of the steel tube and the speed of rotation of the steel tube relative to the sheet metal strip that is being fed from the side at an obtuse angle relative to the longitudinal axis of the steel tube and being welded directly onto the external surface of the steel tube.

A preferred embodiment of the method according to the invention provides that the welding point of the sheet metal strip on the external surface of the steel tube is located on the steel tube immediately at its tangential contact point, so that the sheet metal strip, which is placed tangentially on the external surface and welded there, is fed and oriented approximately at a right angle to the middle axis of the steel tube. The sheet metal strip is placed with its narrow side helically around the cylindrical tube section and/or around the tapered lower section, and is simultaneously softened by the welding so that said sheet metal strip is placed gap-free and with a uniform deformation and curvature onto the external surface of the steel tube. The softening of the sheet metal strip during the welding allows the sheet metal strip to be bent in the direction perpendicular to its narrow side that lies flat against the external surface, without the sheet metal strip being twisted in this process, which would inevitably be the case with cold-forming. This curvature parallel to its broad sides very precisely matches the radius of curvature of the steel tube, so that an approximately perpendicular orientation of the external thread relative to the external surface of the steel tube can be achieved.

The sheet metal strip can be unwound and fed from a supply unit, particularly from a roll, for example, as a result of the rotation of the steel tube and as a result of the simultaneously welding onto its external surface. The welding ensures that the sheet metal strip is positioned precisely and gap-free, since the rotation of the steel tube can ensure the continued feed and unwinding of the strip from the supply unit or from the roll.

Another preferred embodiment of the method according to the invention is characterized in that the sheet metal strip is pressed against the external surface of the steel tube at a defined pre-load force in the area of its contact point and welding point in a perpendicular direction. Moreover, it can be advantageous for the distance between the contact and welding point and the middle axis of the steel tube to be measured, and, depending on the detected distance, for the relationship between the rotational speed of the steel tube and the advancing speed of the steel tube to be adjusted with respect to the point where the sheet metal strip is joined to the external surface of the steel tube. The distance can be measured, for example, by means of an optical measuring device. Thanks to this measuring device and thanks to an evaluation and control unit coupled to it, the welding procedure for applying the external thread can be carried out largely automatically, whereby a very high processing quality can be achieved.

Consequently, the control unit can ensure that the rotational speed of the steel tube is increased while the advancing speed remains constant during the feeding and welding of the sheet metal strip in the area of and in the direction of the lower section of the ground peg that tapers downwards to form the tip. As an alternative to this, it can be provided that the advancing speed between the steel tube and the sheet metal strip is reduced while the rotational speed of the steel tube remains constant during the feeding and welding of the sheet metal strip in the area of and in the direction of the lower section of the ground peg that tapers toward the tip. However, the first variant would probably result in a higher weld seam quality, since, as the radius becomes smaller and the rotational speed becomes correspondingly greater, the circumferential speed at the external surface remains constant, thus ensuring that the welding speed also remains constant. Consequently, a constant welding advance also results in a weld seam having a constant thickness and thus a uniform seam quality over then entire welded length.

Once the tip of the ground peg and thus the end of the external thread has been reached, the welding procedure can be switched off either manually or automatically, and the sheet metal strip can be cut off the fed continuous supply unit, for example, by means of a cutting or shearing process. Optionally, it is also possible to make use of the fact that the sheet metal strip is softened by the welding procedure and to quickly lift the fed sheet metal strip off the welding point, thus causing the sheet metal strip to break away from the lower tip of the ground peg. The feed unit, together with the welding device that is coupled to it—especially a suitable arc welding device with a controlled or constant welding wire feed (e.g. MIG (metal-inert-gas) welding, MAG (metal-active-gas) welding, TIG (tungsten-inert-gas) welding methods, and so on)—can be lifted up, for example, by a suitable lifting cylinder or in some other manner. Thus, it has proven, for example, to be advantageous to press the feeding device, together with the welding device that is attached to it, perpendicularly onto the steel tube by means of spring force, and if necessary, to lift it off the joining point by means of a suitable lifting device that can overcome the spring force.

As an alternative, the external thread can be welded onto the external surface of the ground peg by means of a one-sided fillet weld or by means of a double-sided fillet weld. The automatically controlled welding procedure can ensure a continuous and extremely precise weld seam without any bead formation or visible irregularities. Tests have shown that an optimal weld quality with a virtually constant seam thickness can be achieved by means of the precisely controlled advance and by the very uniform welding at a constant feed rate of the sheet metal strip.

Optionally, the upper section and the lower section of the ground peg can be made in one piece from a single contiguous steel tube section. With this variant, at least three longitudinal slits can be made in the lower section in that triangular sections are removed in the area of the longitudinal slits, whereby the at least three strip sections thus created each taper to form a tip. These strip sections can be welded to each other at least punctually and/or in sections at their side edges that are adjacent to each other. If the welding of the strip sections is dispensed with, then the at least three strip sections of the ground peg are joined together by applying and welding the sheet metal strip of the external thread, and then pressed together to form a tip. The shape of the strip sections is thus maintained by means of the sheet metal strip of the external thread that is welded onto the outside of said strip sections. In this manner, it is not absolutely necessary for the sheet metal strips to be additionally welded together at the abutting places where they are in contact with each other. Rather, it can be sufficient for the sheet metal strips to merely be welded to each other at their lower tips.

The external thread can especially extend continuously with a largely constant pitch between a lower area of the cylindrical section almost all the way to the lower tip of the tapered section.

Finally, the present invention relates to a device for the production of a ground peg from a steel tube, comprising an upper cylindrical section, a lower section that tapers downwards to form a tip, and an external thread that extends along at least a part of the lower section and that is formed from a continuous sheet metal strip that is welded onto an external surface of the ground peg by means of a continuous or regularly interrupted fillet weld. Along its entire length, the external thread has an approximately constant pitch and slope relative to the longitudinal extension of the ground peg. The device according to the invention has a device for clamping and turning the steel tube, and a device for feeding the sheet metal strip to the external surface of the steel tube so as to make tangential contact, whereby the sheet metal strip, which is placed tangentially on the external surface, is fed and oriented approximately at a right angle to the middle axis of the steel tube. Moreover, the device according to the invention has a device for welding the sheet metal strip directly at its tangential contact point to the external surface of the steel tube. In the simplest configuration, the steel tube can be clamped into a conventional lathe in which the steel tube can rotate in a horizontal position. Preferably, it is clamped at both sides so that it cannot be deflected in one direction due to pressure on the sheet metal strip while it is being welded. In the simplest configuration, the feeding device for the sheet metal strip can be a carriage that can be moved in a direction parallel to the lengthwise direction of the steel tube and to which, as a rule, lathe tools or the like can be attached. In the present case, said carriage can serve to affix the feeding device and the welding electrode which, in this case, can be moved either at a predefinable and constant advancing speed or at a variable advancing speed along the longitudinal axis of the rotating steel tube.

The device can also have a device for advancing the steel tube with respect to the stationarily mounted device that serves to feed the sheet metal strip. Optionally, however, the sheet metal strip is moved together with the welding device at a constant advancing speed along the stationarily rotating steel tube. Preferably, a device is provided for coupling the rotational speed of the steel tube and the advancing speed of the steel tube with respect to the stationarily mounted device that serves to feed the sheet metal strip, so that, as the diameter of the lower section becomes smaller, the rotation of the steel tube can be accelerated while the advancing speed of the sheet metal strip and of the welding device remain the same.

Moreover, a device can be provided for measuring the distance between the middle axis of the steel tube and the sheet metal strip that is in contact with the external surface of the steel tube and/or that is pressed there at a defined pre-load force. This device can be, for example, a generally known optical displacement measuring system or the like, which is coupled to the advancing device and which can very precisely detect the distance from the sheet metal strip and from the welding device to the axis of the steel tube so that, on the basis of the detected measuring signal, the rotational speed of the steel tube can be suitably increased while the advancing speed remains the same.

The steel tube itself can be made of a seamless drawn steel tube or optionally of a simple steel tube and with a suitable wall thickness, depending on the diameter and size of the ground peg. The external thread is usually made of a sheet metal strip that can be unwound from a large roll. After the external thread has been welded, the ground peg can be either painted or coated in some other manner. In particular, the ground peg can be provided with a zinc layer applied galvanically or by spray-coating so that it is adequately corrosion resistant. The external thread which, owing to the welding procedure is already in contact with the external surface of the steel tube almost gap-free, can be coated without any problem, whereby the remaining small gaps are normally completely closed by the coating or zinc-plating.

BRIEF DESCRIPTION OF THE DRAWINGS

Further features, objectives and advantages of the present invention can be gleaned from the detailed description below of preferred embodiments of the invention, which serve as non-limiting examples and which make reference to the accompanying drawing.

DETAILED DESCRIPTION

Figure 1:
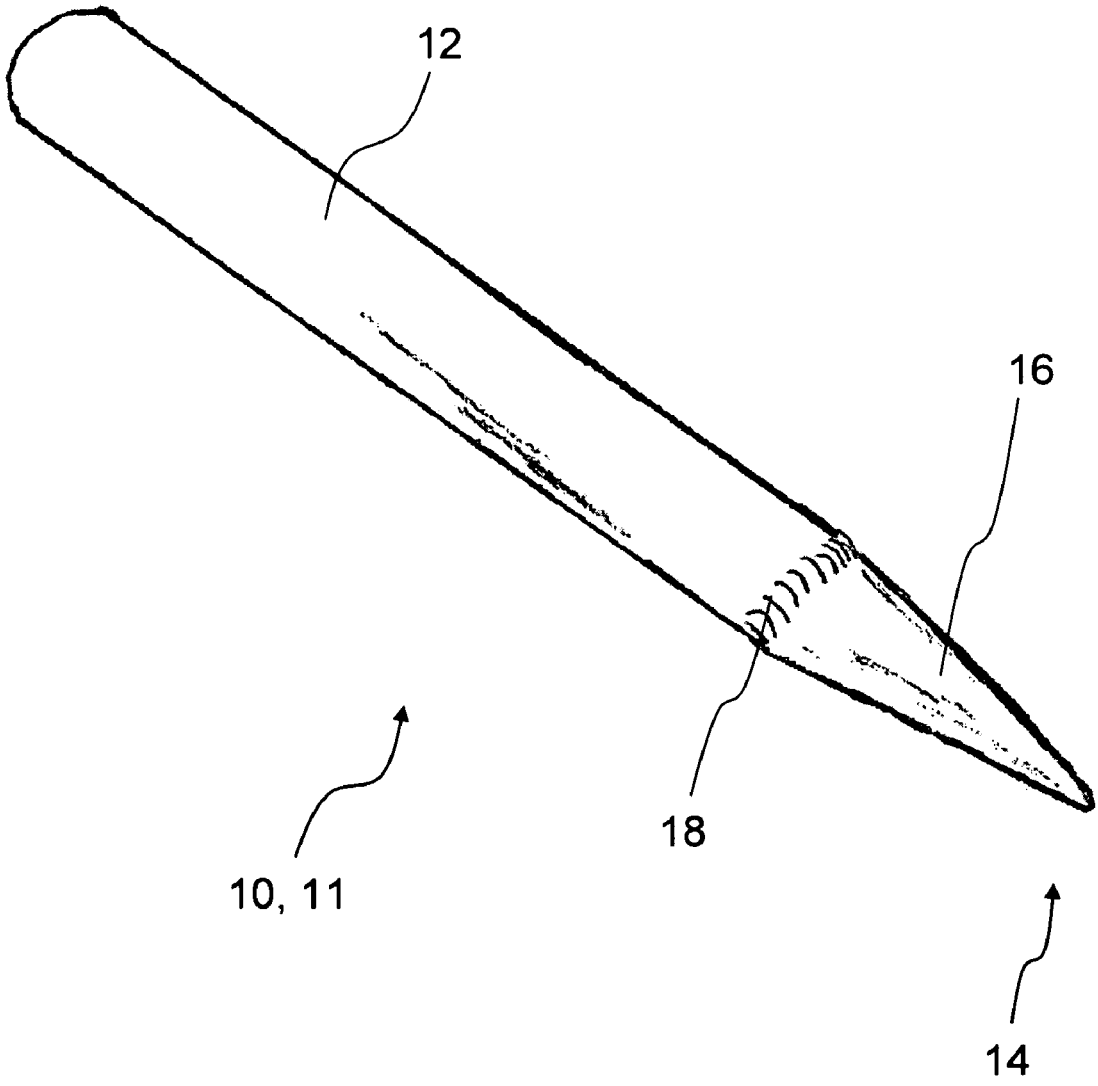
FIG. 1 shows a first variant of a steel tube that has been welded together from two parts and that can be made into a ground peg by welding an external thread onto it.
Figure 2:
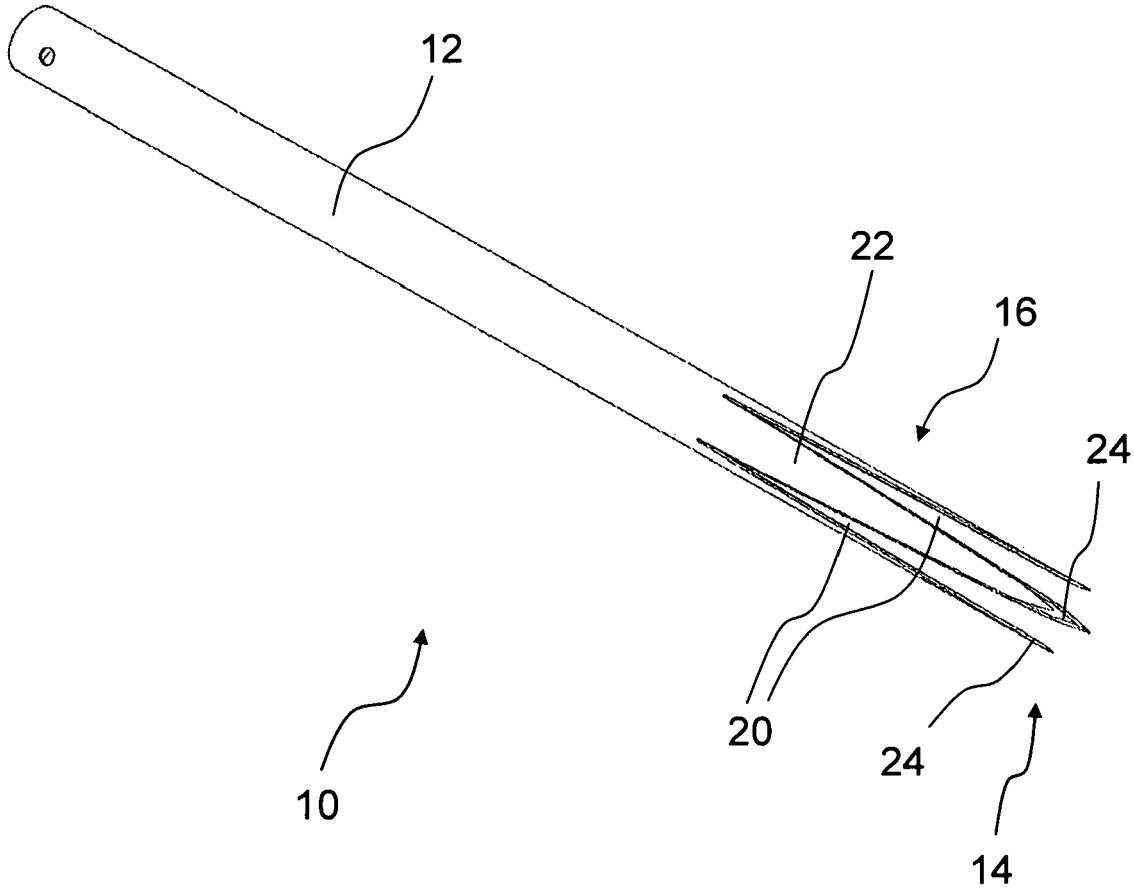
FIG. 2 shows another variant of a one-piece steel tube that can be made into a ground peg by welding an external thread onto it.

The schematic depictions in FIGS. 1 and 2 each show perspective views of a preliminary production stage of a ground peg 10 which is made from a steel tube 11, and which comprises an upper cylindrical section 12 and a lower section 16 that tapers downwards to form a tip 14, and an external thread—not yet applied here—that extends along at least a part of the lower section after it has been applied onto the ground peg 10. In the first variant according to FIG. 1, the upper section 12 and the lower section 16 are formed from two parts that are joined in a ring-shaped weld seam 18. In this variant, the lower section 16 is normally produced by kneading a previously cylindrical steel tube that, in this process, is compacted and shaped to form a generally conical section with a closed tip 14.

In the second variant according to FIG. 2, the upper section 12 and the lower section 16 are made in one piece from a single contiguous steel tube section 11. In the embodiment shown, the lower section 16 has four longitudinal slits 20, whereby material has been removed in the area of the longitudinal slits 20. In the embodiment shown in FIG. 2, pointed triangular sections have been removed in the area of the longitudinal slits 20, so that the lower section 16 is formed by a total of four symmetrical strip sections 22 that each taper downwards toward the lower tip 14. This total of four strip sections 22 each converge to form a tip 24.

The longitudinal slits 20 can advantageously be made by means of a laser cutting process or by another method. Thus, it is fundamentally conceivable to produce the lengthwise cuts by using a suitable tool employing a stamping method.

The depictions in FIGS. 1 and 2 each show the unfinished state of the ground peg 10 after the welding of the upper section 12 and the lower section 16 (FIG. 1), or after the creation of the longitudinal slits 20. Subsequently, the strip sections 22 can optionally be welded to each other at least punctually and/or in sections at their side edges that are adjacent to each other. Optionally, the strip sections 22 can also be welded to each other linearly along their side edges that are adjacent to each other. Moreover, the strip sections 22 can be welded to each other at their tips 24, while forming a lower tip 14 of the ground peg 10.

Since the ground peg 10 according to FIG. 2 is made of a single contiguous steel tube section, it has a largely constant wall thickness in the cylindrical upper section 12 and in the tapered lower section 16. Depending on the further processing, it can be provided that the lower section 16 has a conical shape. This is especially the case if the triangular strip sections 22 are tack-welded to each other so that the middle sections cannot bulge outwards. However, if a slightly bulging contour is desired, then it can be sufficient to merely weld the tips 24 to each other and to subsequently apply the thread (see FIG. 3).

The variant of the ground peg 10 shown in FIG. 2 is especially sturdy and resistant, thanks to its one-piece shape, and it can also be used for very difficult types of ground without failing due to breakage. Since there is no weld seam 18 (see FIG. 1) between the upper section 12 and the lower section 16, the risk of failure due to breakage or cracking in this area is eliminated. Since the ground peg 10 is configured with a largely constant wall thickness in the lower tapered section 16 as well, the ground peg 10 remains torsion-elastic in all of the sections, and it can withstand high torsional loads very well while it is being screwed into very solid and/or particularly hard types of ground.

Figure 3:
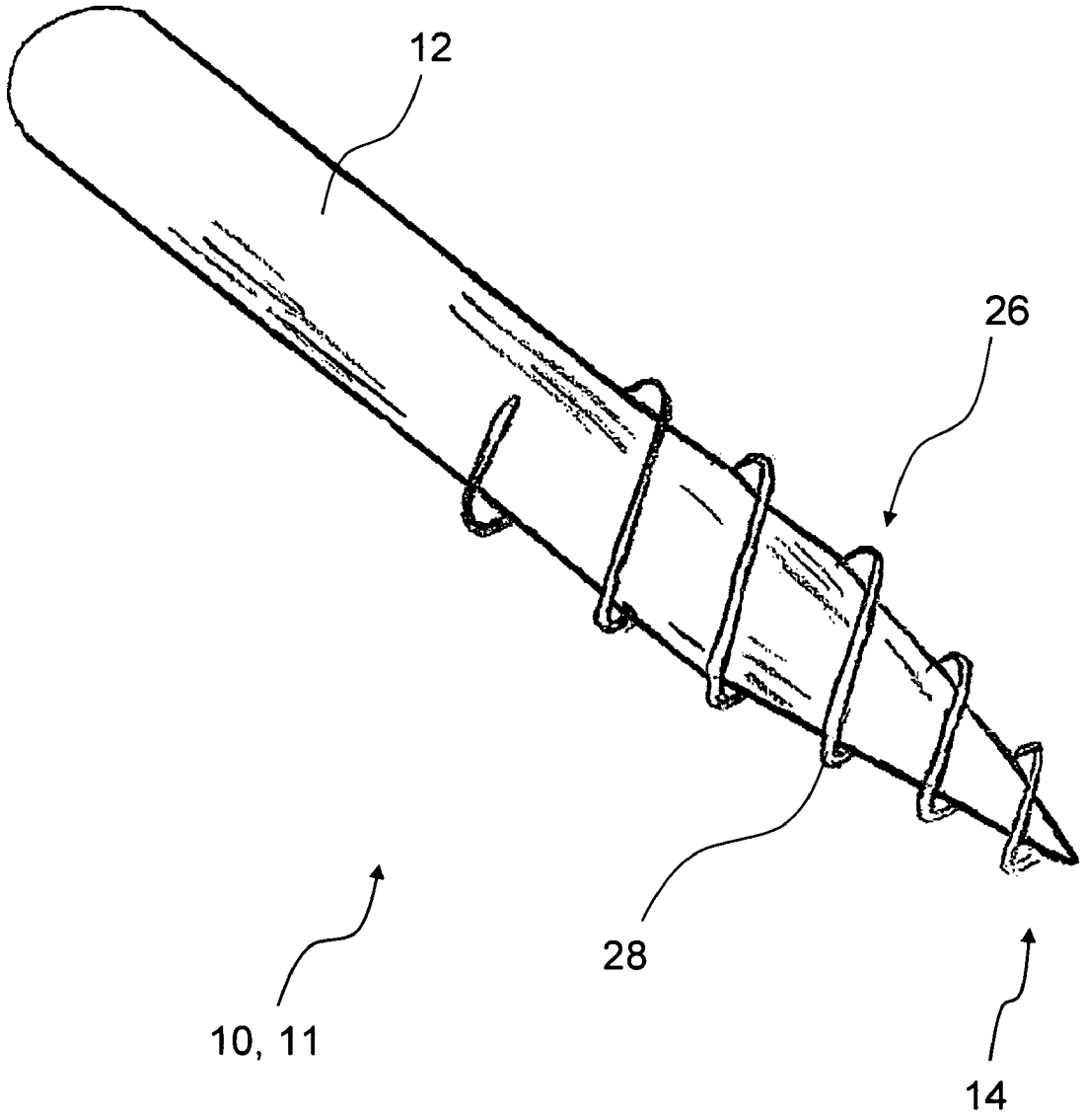
FIG. 3 shows a ground peg with a welded-on external thread.

The schematic depiction in FIG. 3 shows a ground peg 10 with a welded-on external thread 26 that is formed by a sheet metal strip 28 with a rectangular cross-section (see FIG. 4) and that is welded with its narrow side 30 onto the external surface 32 of the upper section 12 and of the lower section 16. This weld seam 34 is configured as a continuous filler weld having a largely constant thickness. The pitch of the external thread 26 is largely constant over its entire length along the upper section 12 as well as along the lower section 16 of the ground peg. Optionally, the sheet metal strip 28 can be welded onto the external surface 32 of the ground peg not only by means of the one-sided fillet weld 34 indicated in FIG. 4 but also by means of a double-sided fillet weld (not shown here).

Figure 4:
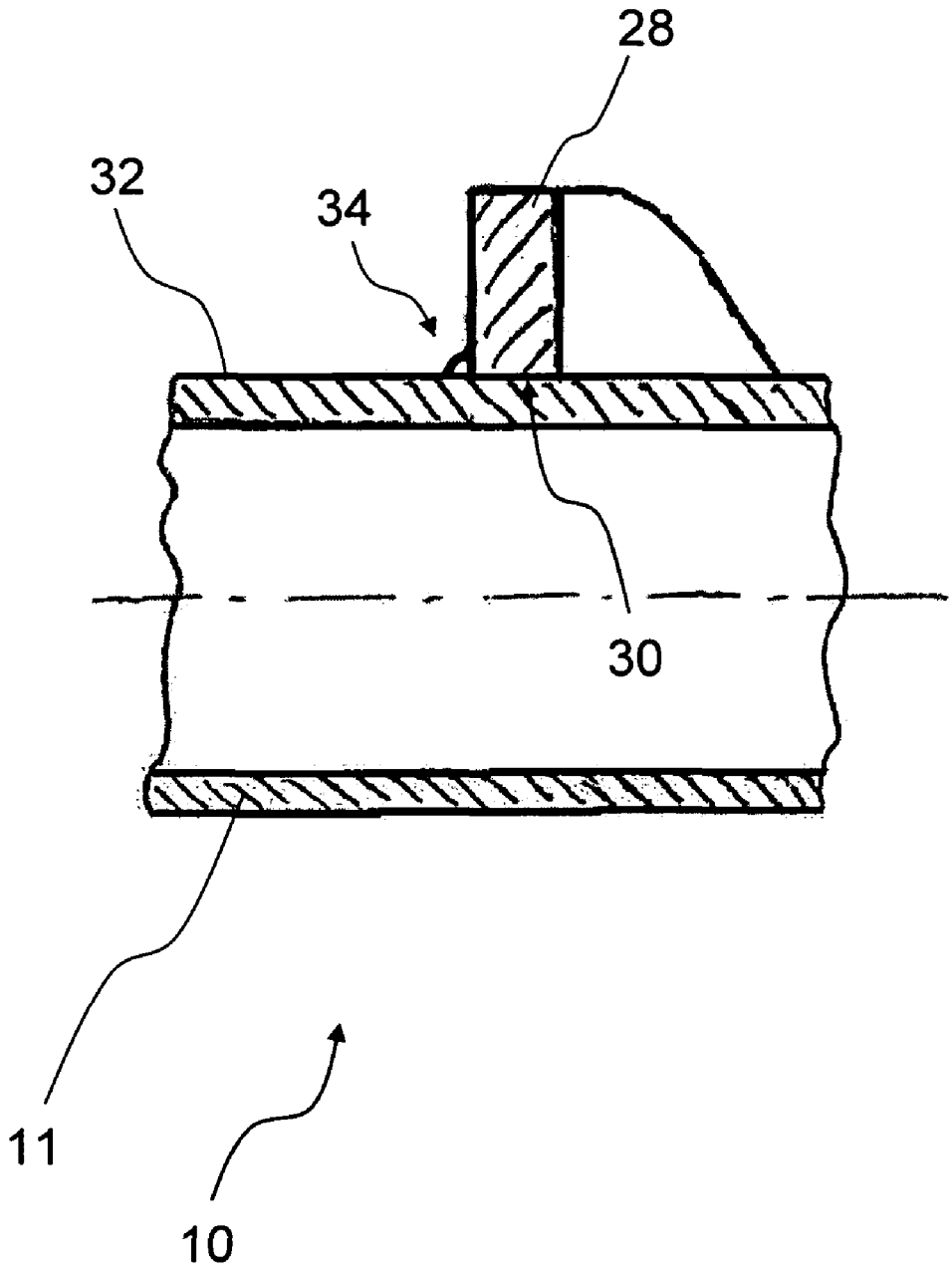
FIG. 4 shows the connection between the external thread and the steel tube of the ground peg in a detailed view.

The external thread 26 shown in FIGS. 3 and 4 is thus formed by the sheet metal strip 28 which runs with its narrow side 30 in a spiral or helical manner around the lower area of the cylindrical tube section 12 and especially around the tapered lower section 16, and which is welded at least punctually and/or in sections onto the external surface 32 of the ground peg 10. The shape of the strip sections 22 of the tapered lower section 16 shown in the variant according to FIG. 2 can optionally be maintained by means of the sheet metal strip 28 of the external thread 26 that is welded onto the outside of said strip sections 22. In this manner, it is not absolutely necessary for the sheet metal strips 22 to be additionally welded together at the abutting places where they are in contact with each other. It can be sufficient for the sheet metal strips 22 to merely be welded to each other at their lower tips 24. The external thread 26 extends continuously and with a largely constant pitch between the lower area of the cylindrical section 12 almost all the way to the lower tip 14 of the tapered section 16.

Figure 5A:
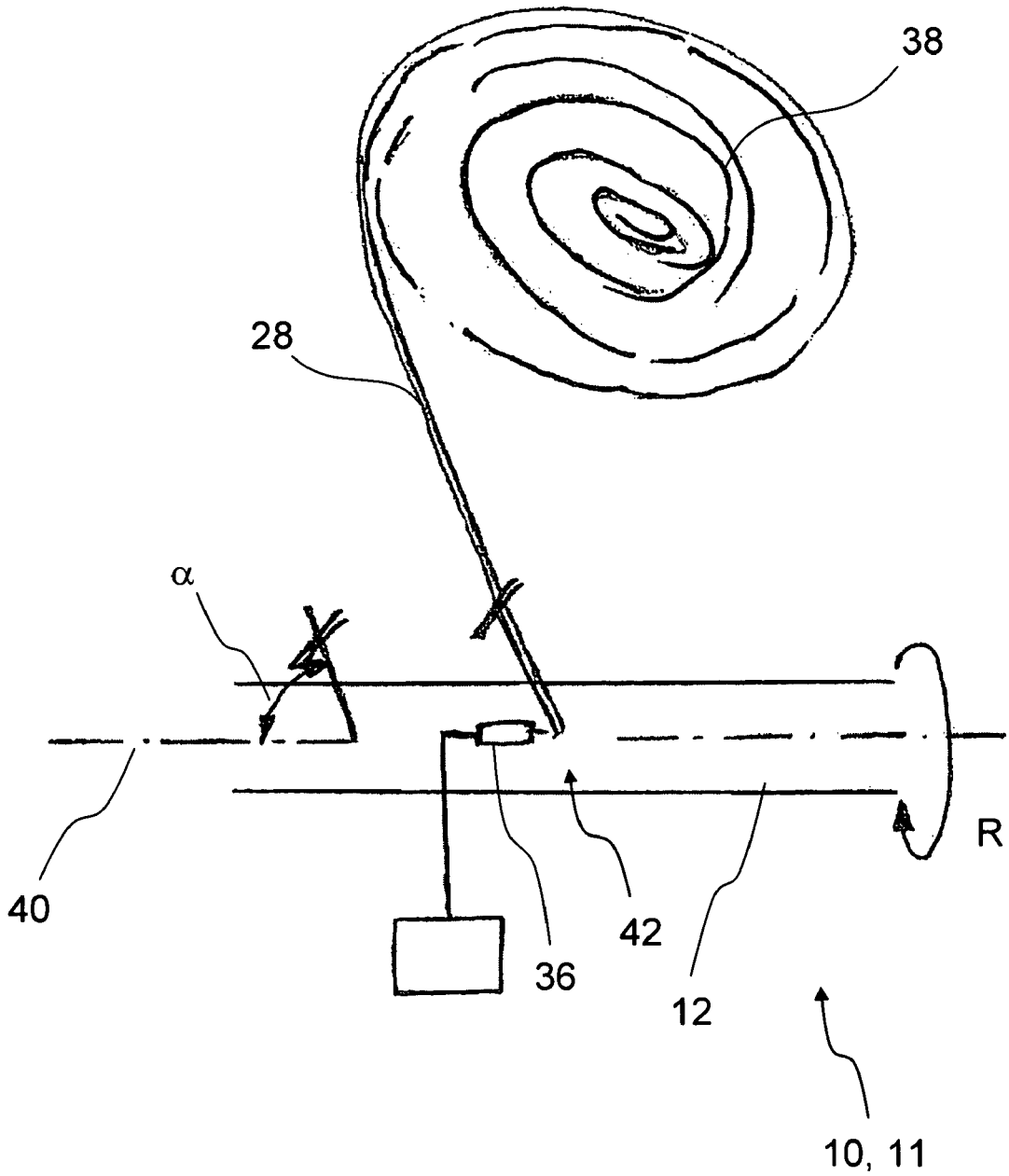
FIG. 5*a/b/c* shown various views illustrating a production process for applying the external thread onto the steel tube.
Figure 5B:
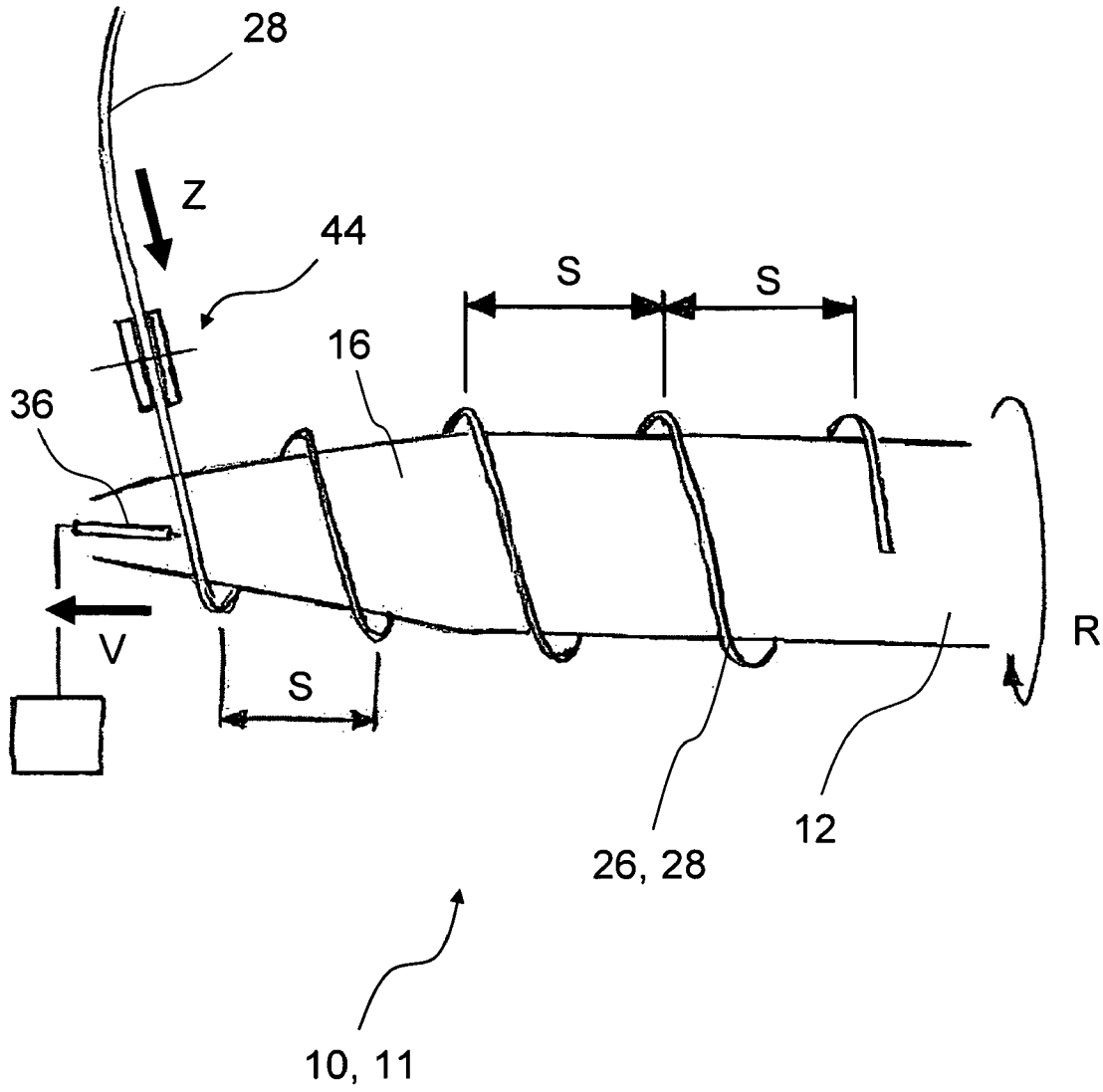
Figure 5C:
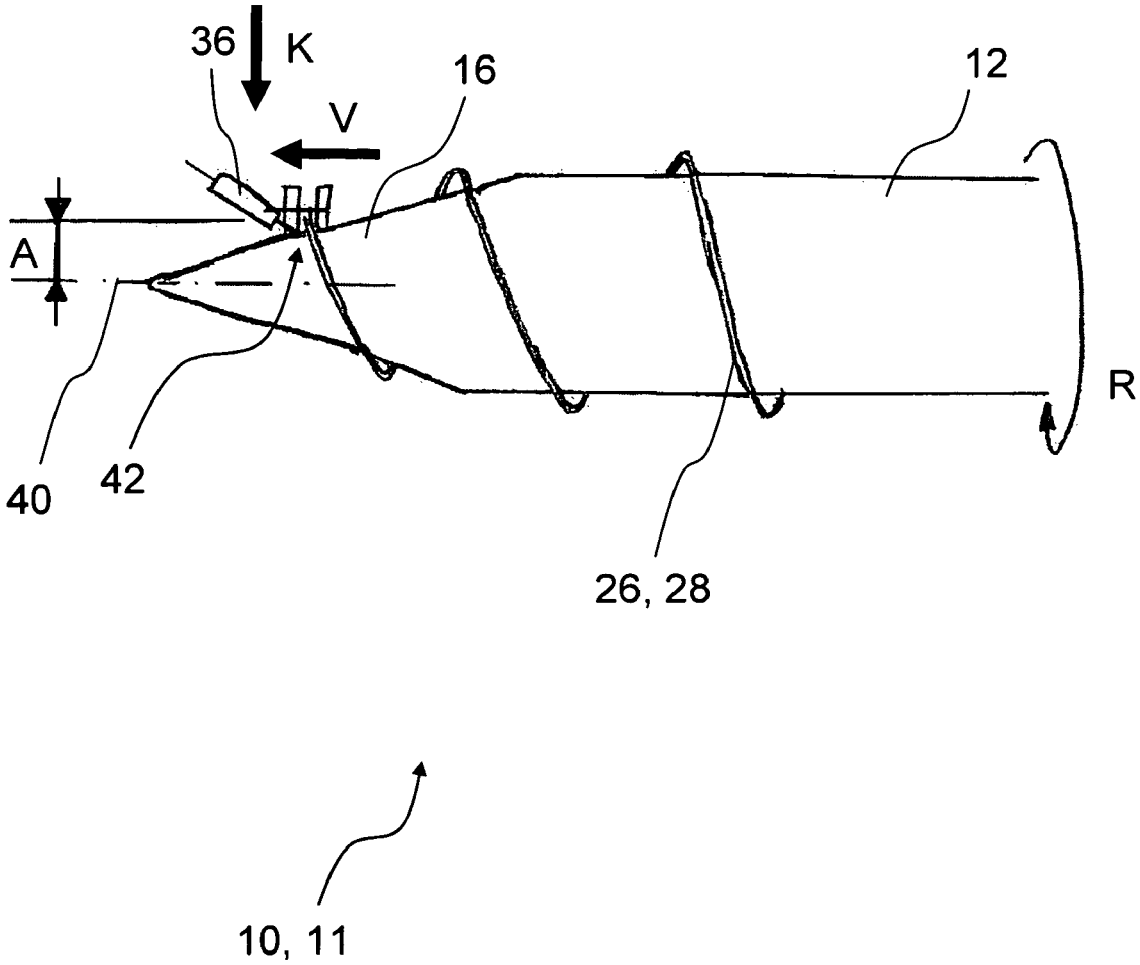

The schematic depictions of FIGS. 5*a*, 5*b* and 5*c* illustrate a production process for applying the external thread 26 onto the external surface 32 of the steel tube 11 of the ground peg 10. Here, the sheet metal strip 28 is first tack-welded by means of a welding device 36 onto the desired starting point in the area of the cylindrical upper section 12. The sheet metal strip 28 that forms the external thread 26 is supplied from a roll 38 or from some other suitable supply unit. The sheet metal strip 28 is placed with its narrow side 30 onto the external surface 32 of the ground peg 10 so that its broad sides project essentially perpendicular from the external surface 32 (see FIG. 4). The slope a of the sheet metal strip relative to the longitudinal axis 40 of the ground peg 10 defines the pitch of the external thread 26 (see FIG. 5*a*).

A rotation R of the steel tube 11 around the longitudinal axis 40 opposite to the feeding direction Z of the sheet metal strip 28 ensures that the sheet metal strip 28 is unwound from the roll 38. Here, the roll 38 is neither actively driven nor is the conveying and/or feeding of the sheet metal strip 28 actively assisted in any other manner. On the contrary, the slight resistance of the sheet metal strip 28, which is under tensile stress, ensures that said sheet metal strip 28 is positioned very precisely around the external surface 32 of the steel tube while the latter is being turned. The welding procedure of the welding device 36, which is oriented at a defined distance and in a defined position with respect to the sheet metal strip 28, also ensures the desired softening of the sheet metal strip 28 at the tack weld 42. The sheet metal strip 28 is thus deformed in the desired direction, so that its narrow side 30 always comes to lie flat on the external surface 32 of the steel tube 11.

FIG. 5*b* illustrates the advance V of the welding device 36 and of the feeding device 44 that is coupled to it for the sheet metal strip 28 in the direction of the longitudinal axis 40, specifically in the direction from the upper section 12 toward the lower section 16 and toward the tip 14 of the ground peg 10, where the welding procedure is ended by cutting off the sheet metal strip. Subsequently, this cut site can be neatly polished so that no sharp edges are left behind.

In order to ensure that the pitch S of the external thread 26 remains approximately constant throughout the ground peg 10, the advancing speed V of the welding device and of the feeding device 44 has to have a fixed relationship with the rotational speed R of the ground peg 10 around its longitudinal axis 40, as long as the sheet metal strip 28 is being welded onto the cylindrical upper section 12. As soon as the lower section 16 that is conical or that tapers in some other way is reached, the rotational speed R has to be gradually increased while the advancing speed V remains constant, so that the welding speed remains the same.

In order to ensure that the rotational speed R is coupled to the advancing speed V, it is advantageous to measure the distance A between the tack weld 42 of the sheet metal strip 28 and the longitudinal axis 40, which can be done in a simple and reliable manner, for example, by means of an optical measuring device (not shown here). On the basis of the signals of this measuring device, the rotational speed R is increased as the measured distance A decreases, until a predefined minimum value is reached at which the welding procedure can be switched off since the tip 14 of the ground peg 10 has been reached.

In the embodiment shown, the very precise, gap-free and dimensionally true welding of the sheet metal strip 28 to form the external thread 26 with an approximately constant pitch S entails several prerequisites. The tack weld 42 and thus the welding point of the welding device 36 have to be arranged approximately radially with respect to the middle axis 40, and it must not be offset to the side. Only then can it be ensured that the welding can also run with the desired precision along the tapered lower section 16. Moreover, a contact pressure K has to be exerted on the sheet metal strip 28 perpendicularly to the feeding direction Z of said sheet metal strip 28, so that pressure is exerted at its tack weld 42 perpendicularly to the external surface 32 of the steel tube in the direction of the middle axis 40. This contact pressure K does not have to be very great, but it should be sufficient to prevent the sheet metal strip 28 from lifting off the external surface 32 during the welding procedure. This contact pressure K can be exerted, for example, by a suitable spring-loaded pressure mechanism and/or with a pneumatic cylinder or the like. Once the tip as been reached and once the welding procedure has been completed, the pressure mechanism can be deactivated and the sheet metal strip 28, together with the welding device 36, can be lifted off the ground peg 10.

It is obvious to the person skilled in the art that the described movement sequences during the application of the external thread 26 can also be effectuated in another manner, for example, with the assistance of a welding robot that can be moved along the outer contour of the ground peg 10. This process can also be kinematically reversed, so that, for example, the welding device 36 can be stationary and the ground peg 10 can be moved in the lengthwise direction. This does not change the fundamental principles of the present invention.

Moreover, it should be pointed out that the present invention is by no means to be construed as being limited to the above-mentioned embodiments. On the contrary, numerous variants and modifications are conceivable that make use of the idea according to the invention and that consequently likewise fall within the scope of protection.

LIST OF REFERENCE NUMERALS

10 ground peg
11 steel tube
12 upper section
14 tip
16 lower section
18 ring-shaped weld seam
20 longitudinal slit
22 strip section
24 tip
26 external thread
28 sheet metal strip
30 narrow side
32 external surface
34 fillet weld
36 welding device
38 roll
40 longitudinal axis
42 tack weld
44 feeding device
A distance
K contact pressure
R rotation/rotational speed
S pitch
V advance/advancing speed
Z feed/feeding direction
α slope

What is claimed is:

1. A method for producing a ground peg made from a steel tube and comprising at least an upper cylindrical section, a lower section tapering towards a bottom to form a tip, and an external thread extending along at least a part of the lower section, the external thread being formed from a continuous sheet metal strip welded onto an external surface of the ground peg using a continuous or regularly interrupted fillet weld, the method comprising:

laterally feeding the external thread to the external surface of the steel tube as the steel tube rotates, the external thread being an elongate sheet metal strip; and welding the sheet metal strip onto said external surface; and moving the steel tube relative to a feeding point of the sheet metal strip at a regular advance in a longitudinal direction of the steel tube;

wherein the upper section and the lower section of the ground peg is a single piece of a continuous steel tube section, wherein at least three longitudinal slots are inserted in the lower section by removing triangle-shaped sections in the area of the longitudinal slots, wherein the at least three stripe portions formed thereof peak in each case in a cusp, and wherein the at least three stripe portions of the ground peg are joined together by applying and welding of the sheet metal strip of the external thread and pressed together to form the tip.

2. The method as recited in claim 1 wherein the sheet metal strip of the external thread is fed and welded along its entire length with a nearly constant pitch and slope relative to a longitudinal axis of the ground peg.

3. The method as recited in claim 1 wherein the sheet metal strip of the external thread is fed in a nearly constant angle to a longitudinal axis of the steel tube, wherein this feeding angle is the slope of the external thread.

4. The method as recited in claim 1 wherein the sheet metal strip of the external thread is fed and welded with longitudinal sides nearly perpendicular to a longitudinal axis of the steel tube.

5. The method as recited in claim 1 wherein the steel tube of the ground peg rotates during the welding of the sheet metal strip in an area of the upper cylindrical section with an increased rotation speed compared to the regular advance of the steel tube with reference to the feeding point of the sheet metal strip.

6. The method as recited in claim 1 wherein the steel tube of the ground peg rotates during the welding of the sheet metal strip in an area of the lower section with an increased rotation speed compared to the regular advance of the steel tube with reference to the feeding point of the sheet metal strip.

7. The method as recited in claim 6 wherein the rotation speed of the steel tube is constantly increased with diminishing spacing of the sheet metal strip at an external surface of the steel tube to the longitudinal axis of the steel tube.

8. The method as recited in claim 5 wherein the steel tube rotates quicker the smaller a spacing of the sheet metal strip at an external surface of the steel tube to the longitudinal axis of the steel tube is.

9. The method as recited in claim 1 wherein the sheet metal strip is pressed with a defined preload force in the area of the weld in a perpendicular direction against the external surface of the steel tube.

10. The method as recited in claim 9 wherein a spacing of the weld to the longitudinal axis of the steel tube is measured and the relation between the rotation speed of the steel tube and the regular advance of the steel tube is adjusted depending on the detected spacing compared to the weld of the sheet metal strip with the external surface of the steel tube.

11. The method as recited in claim 10 wherein the rotation speed of the steel tube is increased with a constant remaining regular advance during the feeding and welding of the sheet metal strip in the area of and in direction to the lower section.

12. The method as recited in claim 10 wherein the regular advance between the steel tube and the sheet metal strip is reduced with a constant remaining rotation speed of the steel tube during the feeding and welding of the sheet metal strip in the area of and in direction to the lower section.

13. The method as recited in claim 1 wherein the weld is a tack weld.

* * * * *